US011833563B2

(12) United States Patent
Hopf

(10) Patent No.: US 11,833,563 B2
(45) Date of Patent: Dec. 5, 2023

(54) ADJUSTABLE DENT REMOVAL TOOL

(71) Applicant: Steven Hopf, Riverside, CA (US)

(72) Inventor: Steven Hopf, Riverside, CA (US)

( * ) Notice: Subject to any disclaimer, the term of this patent is extended or adjusted under 35 U.S.C. 154(b) by 47 days.

(21) Appl. No.: 17/241,527

(22) Filed: Apr. 27, 2021

(65) Prior Publication Data

US 2021/0245220 A1 Aug. 12, 2021

Related U.S. Application Data

(63) Continuation-in-part of application No. 16/286,351, filed on Feb. 26, 2019, now Pat. No. 11,247,254.

(51) Int. Cl.
*B21D 1/06* (2006.01)

(52) U.S. Cl.
CPC ..... *B21D 1/06* (2013.01)

(58) Field of Classification Search
CPC ..... B21D 1/06; B21D 1/08; B21D 1/10
See application file for complete search history.

(56) References Cited

U.S. PATENT DOCUMENTS

| | | | | |
|---|---|---|---|---|
| 751,345 | A | 2/1904 | Saunders | |
| 4,480,511 | A | 10/1984 | Nickipuck | |
| 4,692,073 | A | 9/1987 | Martindell | |
| 4,768,405 | A | 9/1988 | Nickipuck | |
| 4,781,085 | A | 10/1988 | Fox, III | |
| 4,900,202 | A | 2/1990 | Wienhold | |
| 5,013,194 | A | 5/1991 | Wienhold | |
| 5,333,523 | A | 8/1994 | Palm | |
| 5,398,946 | A | 3/1995 | Quiring | |
| 5,779,404 | A | 7/1998 | Jore | |
| 5,813,296 | A | 9/1998 | Hoff et al. | |
| 5,873,289 | A | 2/1999 | Jarvis | |
| 5,934,384 | A | 8/1999 | Wang | |
| 6,176,654 | B1 | 1/2001 | Jore | |
| 6,394,715 | B1 | 5/2002 | Boyle et al. | |
| 6,533,291 | B2 | 3/2003 | Huggins et al. | |
| 7,156,005 | B2 | 1/2007 | Cluthe | |
| 9,868,143 | B2 | 1/2018 | Zimmerman | |
| 9,999,912 | B2 * | 6/2018 | Schaechinger | B21D 1/06 |
| 2009/0056407 | A1 | 3/2009 | Greene | |
| 2017/0216899 | A1 * | 8/2017 | Zimmerman | B21D 1/06 |

* cited by examiner

*Primary Examiner* — Teresa M Ekiert

(57) ABSTRACT

An adjustable dent removal tool may include a handle coupled to a duel adjustment system, the duel adjustment system may include a body secured to the handle. The body may include a plurality of first engagement teeth. A piston may be provided that may be movably coupled to the body, the piston may include a plurality of second engagement teeth, which may be selectively engaged with the first engagement teeth, thereby releasably locking the body to the piston. A lower body may be secured to the body. The lower body may include a tool receiver. A tool shaft may be provided that may be releasably locked to the lower body in more than one position. The handle may be comprised of a plurality of handle segments each with a male and a female coupling, the segments releasably secured to one another and to a receiver body with two female couplings.

18 Claims, 11 Drawing Sheets

ADJUSTABLE DENT REMOVAL TOOL

CROSS-REFERENCE TO RELATED APPLICATION DATA

This application is a continuation-in-part of application Ser. No. 16/286,351 filed on Feb. 26, 2019, which is incorporated by reference herein.

FIELD OF THE INVENTION

The present invention generally relates to hand tools, more particularly, to tools used to remove dents from metal covers such as the body of a vehicle.

BACKGROUND OF THE INVENTION

Hand tools have been used throughout history. As machinery has increased in complexity, so has the need for tools that can more efficiently meet the needs of the worker with the tool in their hands. Dent removal tools are a special breed of tools as they may be used to remove dents from a sheet metal workpiece, such as anyplace on the body of a vehicle. The purpose of dent removal tools may be to remove dents without the need of repainting the workpiece after removing the dent. In contrast, a new part may be fabricated or a damaged part may be altered by aggressive removal of material or the addition of a filler to fill any depressions in the workpiece to give the appearance of a smooth part. After this type of work, the part must be painted to match the rest of the vehicle. This process is usually much more time consuming and costly as opposed to "working" a dent out by utilizing dent removal tools, which is usually faster and may not require repainting when finished.

The process of "working" out a dent may require a degree of skill as well as just applying a force to push the dent out. In many cases an extended tool with a tool tip may be used where the tool tip is what contacts the dent on the convex side of the dent. Force is applied to the tool, and thereby to the tool tip, sometimes in many small steps and from different angles and directions to work the dent out and finish with a flat and smooth finish on the workpiece. When an object hits a vehicle body, the dent may commonly be pressed from the outside of the vehicle in toward the inside of the vehicle. Therefore the convex portion of the dent may be hidden and obstructed by other parts of the vehicle body. As such, different tools with different configurations and lengths may be needed by the worker. Many traditional dent removal tools are of a welded construction so multiple tools may be needed by the worker to accomplish the task of removing the dent.

It should, therefore, be appreciated that there is a need for an adjustable dent removal tool in which the handle of the tool may be manipulated independently from a removable tool shaft, thereby making one handle assembly and multiple tool shafts functionally similar to a large number of individual dent removal tools. This may save time for the worker and save investment cost to the worker by providing one adjustable dent removal tool and eliminating the need to multiple independent dent removal tools.

SUMMARY OF THE INVENTION

The present invention may include a handle coupled to a duel adjustment system, the duel adjustment system may include a body secured to the handle. The body may include a plurality of first engagement teeth. A piston may be provide that may be movably coupled to the body, the piston may include a plurality of second engagement teeth. A piston spring may provide a bias of the piston toward the body such that the second engagement teeth of the body interlock with the first engagement teeth of the body.

A lower body may be secured to the body, the lower body may include a locking ball which may articulate with a ring, such that the ring holds the ball in a recessed position when the ring is in a first position and allows the ball to move to a retracted position when the ring is in a second position. The lower body may also include a tool receiver and a lower body spring supported by the lower body, the lower body spring providing a bias of the ring toward the first position. The tool may also include a tool shaft with a tool tip and an attachment end substantially opposite to the tool tip. The attachment end of the tool shaft may be received by the tool receiver of the lower body and releasably secured thereto when the locking ball is in the recessed position.

The adjustable dent removal tool may also include the lower body being secured to the body by way of a lower body screw. The lower body screw may be a threaded fastener. The attachment end of the tool shaft may include a ball groove that may receive a portion of the locking ball when the locking ball is in the recessed position. The locking ball may not contact the ball groove of the tool shaft when the locking ball is in the retracted position, thereby allowing the tool shaft to be inserted into, or removed from, the lower body.

The piston may be movably coupled to the body about a common axis, thereby the body may be displaced from the piston such that the first engagement teeth of the body are not engaged with the second engagement teeth of the piston and the body may be rotated with respect to the piston about the common axis. The displacement of the body from the piston may result in an increased compression of the piston spring while in this position. The tool receiver of the lower body may include one or more flat surfaces and the attachment end of the tool shaft also includes one or more flat surfaces, whereby when a flat surface of the tool receiver mates with a flat surface of the attachment end of the tool shaft, the combination provides a resistance to rotation of the tool shaft relative to the lower body.

The invention may also include a method of removing a dent including the structural elements are previously noted and includes the steps of moving the ring to allow the tool shaft to be placed in the lower body and locking it in a position by moving the ring so the locking ball is in the recessed position. Then positioning a portion of the tool shaft adjacent to a dent in a workpiece and applying force to the handle to manipulate the dent in the workpiece. Then applying force to the handle to disengage the first engagement teeth of the body from the second engagement teeth of the piston and rotating the handle, and therefore the body, relative to the piston and then allowing the first engagement teeth of the body to engage with the second engagement teeth of the piston, thereby locking the body to the piston. Then applying force to the handle to apply a modified force to the dent in the workpiece due to the change in the handle position relative to the tool shaft.

Another embodiment of the present invention may include an elongate handle comprised of a plurality of handle segments of varying lengths. The plurality of handle segments may have male and female couplings one on each end of each of the handle segments. The receiver body may include two female couplings positioned along a common axis. The lower body of the receiver body may be positioned perpendicular to the common axis of the receiver body. A handle grip may be releasably secured to the elongate handle, the handle grip may include a handle bar with a long axis positioned perpendicular to a long axis of the elongate handle. A handle grip connector may also be provided that may include a male coupling on one end, the handle bar may be secured to the handle grip. The handle grip may also include a flat support bar with a long dimension positioned perpendicular to a long axis of the elongate handle. A ball handle may be provided with a threaded portion received by an end cap, the end cap including a male coupling received by one of the handle segments.

For purposes of summarizing the invention and the advantages achieved over the prior art, certain advantages of the invention have been described herein. Of course, it is to be understood that not necessarily all such advantages can be achieved in accordance with any particular embodiment of the invention. Thus, for example, those skilled in the art will recognize that the invention can be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following description of the preferred embodiments and drawings, the invention not being limited to any particular preferred embodiment(s) disclosed.

BRIEF DESCRIPTION OF THE DRAWINGS

Embodiments of the present invention will now be described, by way of example only, with reference to the following drawings, in which.

DETAILED DESCRIPTION OF THE INVENTION

Figure 1:
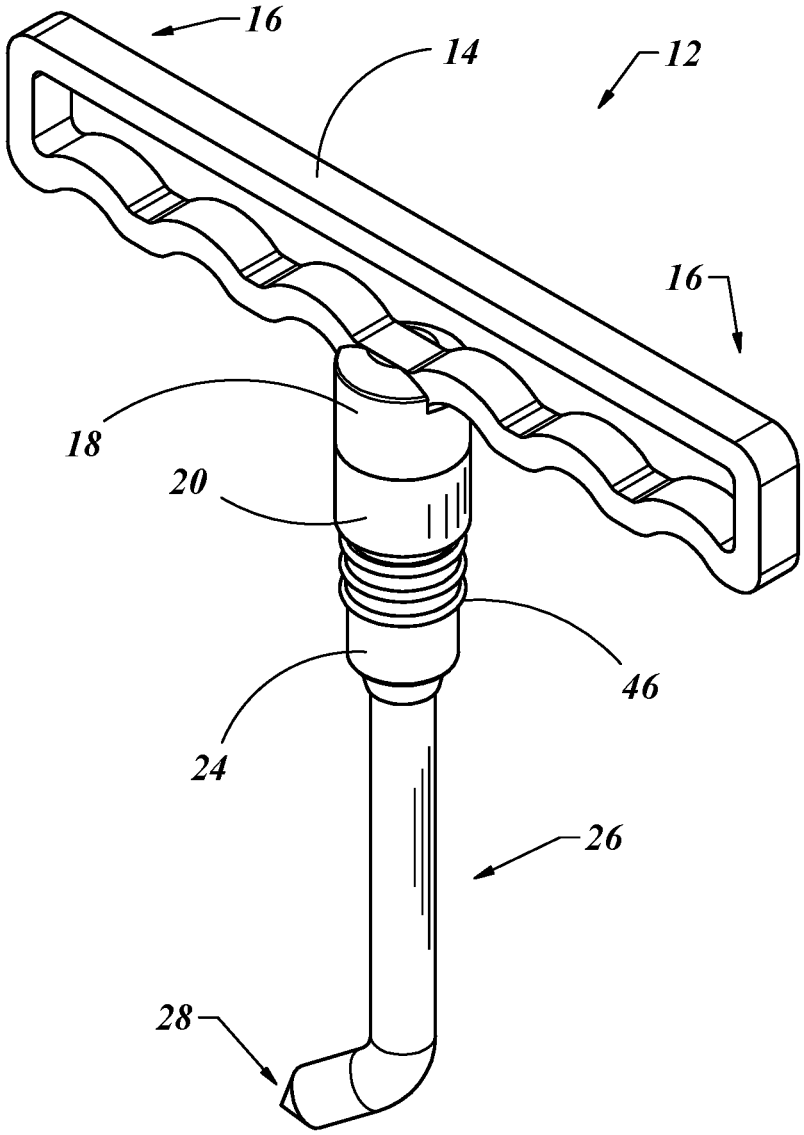
FIG. 1 is an isometric view of an adjustable dent removal tool in a fully assembled state.

With reference to the illustrative drawings and particularly to FIG. 1, there is shown an adjustable dent removal tool 12. The adjustable dent removal tool 12 may include a handle 14, which may have an extension 16 on one or both sides (as shown in FIG. 1) of a cap 18. The cap 18 may be securely coupled to the handle 14 by welding or otherwise fastened in some manner. The cap 18 may be securely coupled to a body 20. The cap 18 and the body 20 may be substantially cylindrical in shape and coupled together with a central axis of both the cap 18 and the body 20 positioned collinear to one another. In this manner, the combination of the cap 18 and the body 20 may provide a singular cylindrical structure that another cylindrical element may rotate about. A ring 46 may be positioned adjacent to the body 20 and a lower body 24 may provide a means for releasably receiving a tool shaft 26. The tool shaft 26 may include a tool tip 28, which may be used to contact a dent on a workpiece.

Figure 2:
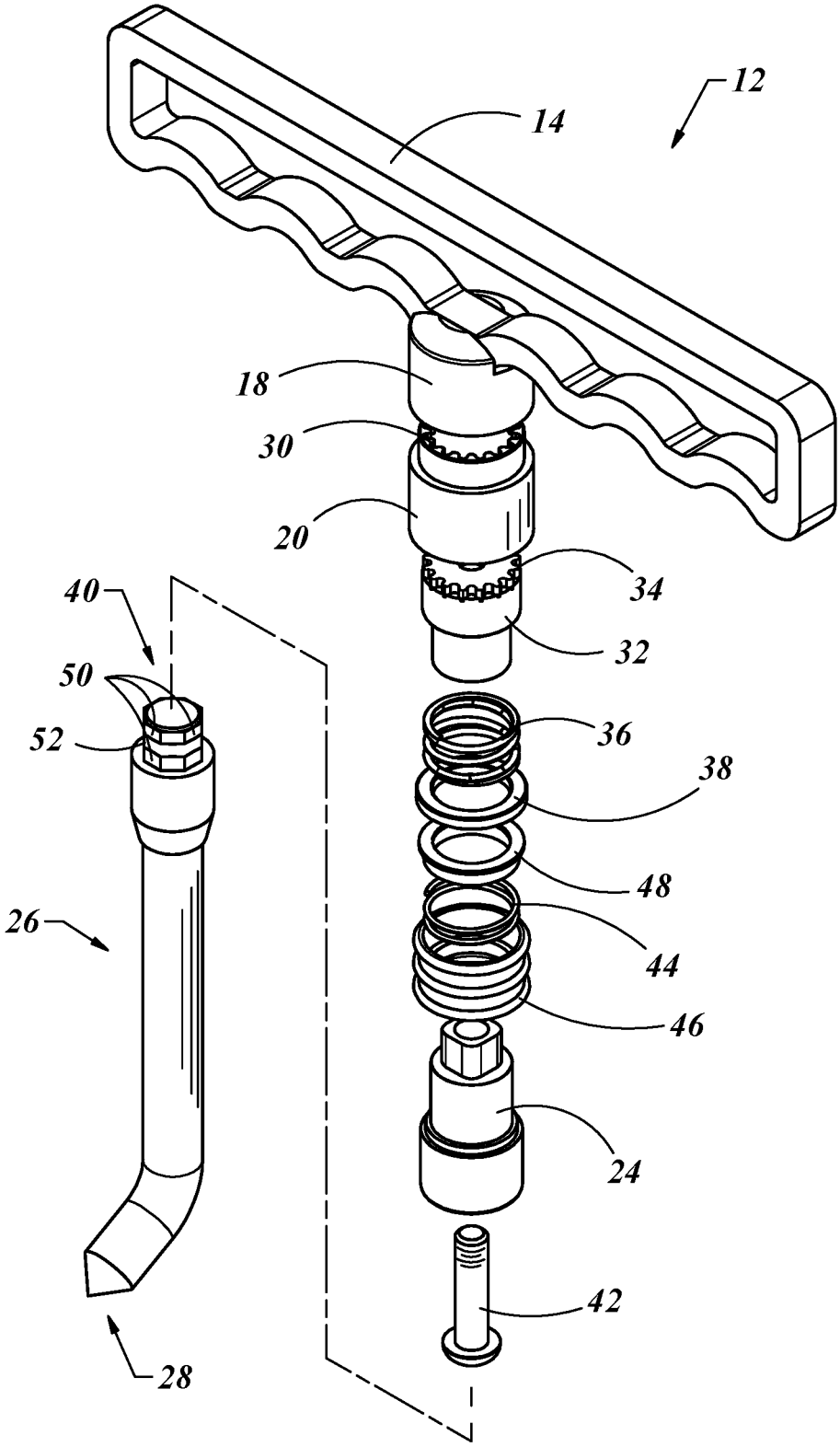
FIG. 2 is an exploded view of the adjustable dent removal tool as presented in FIG. 1.

An exploded view of the adjustable dent removal tool 12 is shown in FIG. 2. In this view much of the additional detail of the assembly is shown. The body 20 may also include a plurality of first engagement teeth 30, which may be provided on an end of the body 20 nearest the cap 18. As previously mentioned, the body 20 and the cap 18 may be securely mounted to one another by welding or some other method.

A piston 32 may be provided that may be substantially cylindrical in shape and is capable of being received by the body 20, such that the piston 32 may be movably mounted to the body 20. The piston 32 may slidably move closer to the handle 14 or further away from the handle 14 when assembled. The piston 32 may also be free to rotate about a common central axis of the piston 32 and the body 20. To stop the free rotation of the piston 32 relative to the body 20, the piston 32 may include a plurality of second engagement teeth 34 to which the first engagement teeth 30 of the body 20 may interface with the second engagement teeth 34 of the piston 32 when the piston 32 is fully inserted into the body 20.

When the first engagement teeth 30 are interlocked with the second engagement teeth 34, the piston 32 may be functionally locked to the body 20, with regard to rotation. If the piston 32 is displaced a distance away from the handle 12, such that the first engagement teeth 30 are not longer contacting the second engagement teeth 34, the piston 32 may rotate freely with respect to the body 20 while the piston 32 is still substantially positioned within the body 20. The outer surface of the piston 32 may articulate with the inner surface of the body 20, thereby providing a bearing surface between the two parts to enable smooth rotation of the piston 32 relative to the body 20, and therefore the cap 18 and handle 14, when the first engagement teeth 30 are not in contact with the second engagement teeth 34. A piston spring 36 may be supported by a washer 38. The washer 38 may be press fit into the body 20 thereby capturing the piston 32 and the piston spring 36 within the body 20. The piston spring 36 may provide a bias of the piston 32 in the direction of the body 20, such that the relaxed position of the piston 32 relative to the body 20 is that the first engagement teeth 30 of the body 20 are engaged with the second engagement teeth 34 of the piston. This combination may comprise the first assembly of a duel adjustment system.

A second assembly of the duel adjustment system may include a tool shaft 26 with an adjustment end 40 that is adapted to be received by the lower body 24. The lower body 24 may be coupled to the piston 32 by way of a lower body screw 42. A lower body spring 44 and a ring 46 may be received by a portion of the lower body 24. A spring washer 48 may be pressed onto a portion of the lower body 24 to cap off the second assembly of the duel adjustment system. The attachment end 40 of the tool shaft 26 may include one or more flat surfaces 50 and a ball groove 52. The details of how each of the first assembly of the duel adjustment system and the second assembly of the duel adjustment system are shown in more detail in the following figures.

Figure 4:
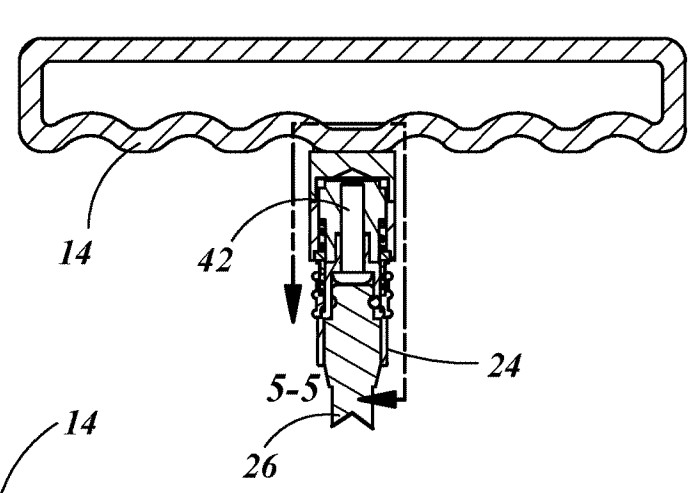
FIG. 4 is a sectioned view of the adjustable dent removal tool as presented in FIG. 3, cut along line 4-4.
Figure 5:
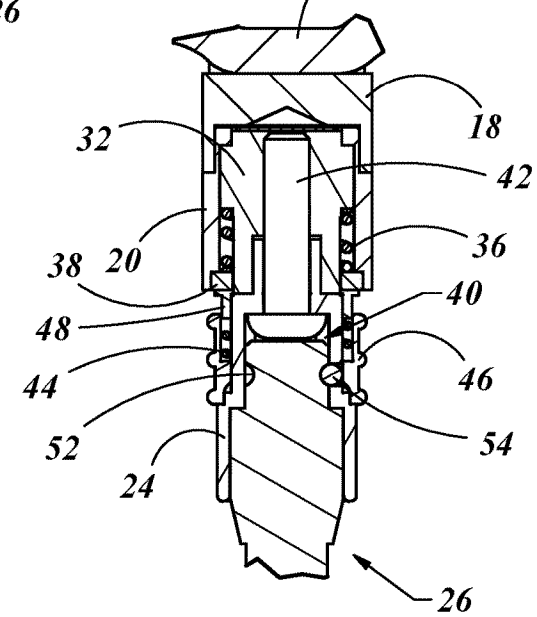
FIG. 5 is a detail view of the adjustable dent removal tool as presented in FIG. 4 cut along line 5-5.
Figure 3:
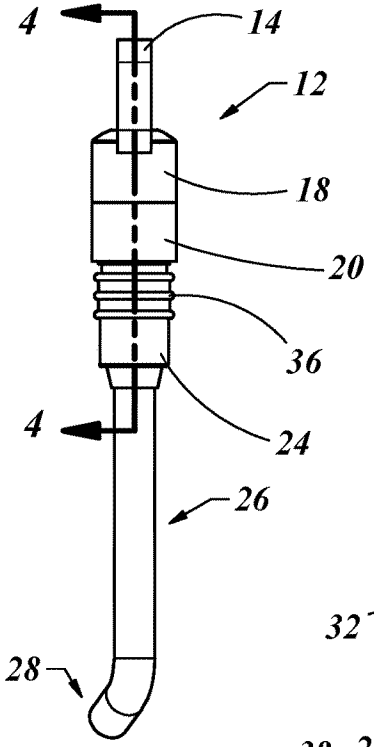
FIG. 3 is a side view of the adjustable dent removal tool as presented in FIG. 1.

With reference to FIGS. 3-5, an adjustable dent removal tool 12 is shown from a side view. This view includes a section line 4-4, in which the section view is shown in FIG. 4. The detail of this section view is shown more clearly in FIG. 5. These views show the adjustable dent removal tool 12 in an assembled state, as is illustrated in FIG. 1, with the attachment end 40 of the tool shaft 26 received in the lower body 24. What was not previously shown was that the tool shaft 26 may be releasably secured to the lower body 24 by way of a locking ball 54, which may be received by the ball groove 52 on the attachment end 40 of the tool shaft 26. The locking ball 54, when recessed by the current position of the ring 46, and received by the ball groove 52 of the tool shaft 26, prevents the tool shaft 26 from disengaging from the lower body 24. One or more of the flat surfaces 50 of the attachment end 40 of the tool shaft 26 may contact one or more flat surfaces on the inside of the lower body 24, thereby preventing the tool shaft 26 from rotating with respect to the lower body 24. By providing more than one flat surface 50 on the attachment end 40 of the tool shaft 26, and also on the inside of the lower body, the tool tip 28 of the tool shaft 26 may be positioned in more than one angular position relative to the lower body 24.

The number of flat surfaces 50 on the attachment end 40 and also on the lower body 24 may define how many positions the tool tip 28 may face relative to the lower body 24. For example, if there is only one flat surface 50, then when the tool shaft 26 can only be inserted into the lower body 24 in one position, so the tool tip 28 can only face one direction. If two flat surfaces 50 are provided, then the tool shaft 26 may be inserted in the lower body in two different positions, thus providing the tool tip 28 in two relative positions. The number of flat surfaces 50 is not critical to the novelty of the invention but the inventor as determined an optimal number of flat surfaces 50 to be eight, so that the tool tip 28 may be positioned in eight different positions relative to the lower body 24. This multi-positional location of the toll tip 28 relative to the lower body 24 may be considered are result of the second of the duel adjustment system.

Figure 7:
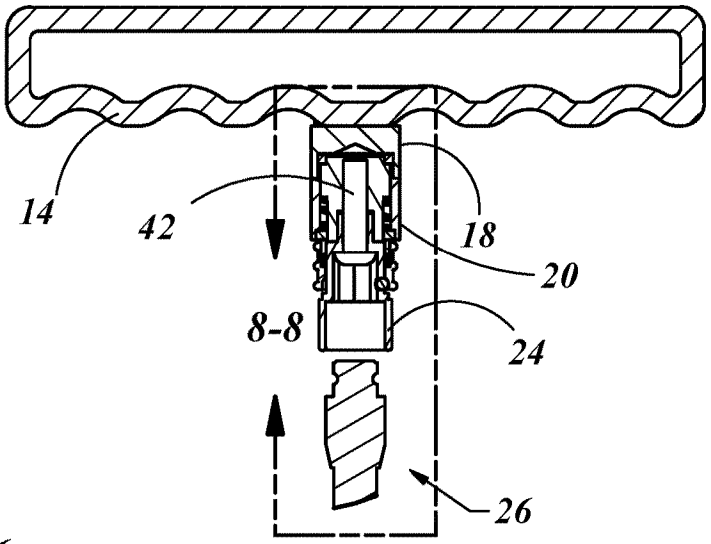
FIG. 7 is a sectioned view of the adjustable dent removal tool as presented in FIG. 6, cut along line 7-7.
Figure 8:
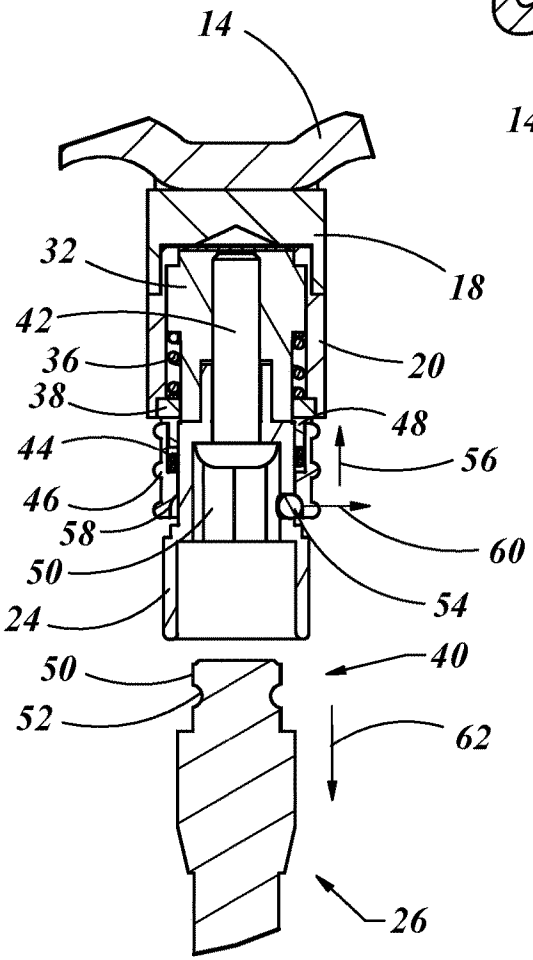
FIG. 8 is a detail view of the adjustable dent removal tool presented in FIG. 7 and cut along line 8-8.
Figure 6:
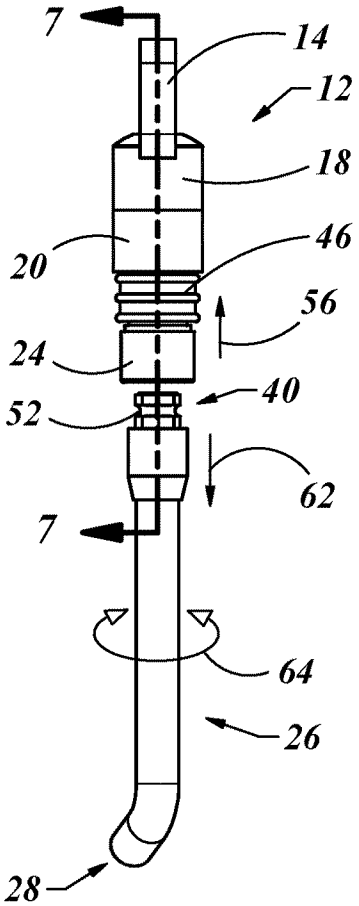
FIG. 6 is a side view of the adjustable dent removal tool as presented in FIG. 1, with the ring moved, the locking ball retracted and the tool shaft displaced from the lower body.

More detail of this second assembly of the duel adjustment system is shown in FIGS. 6-8, where the tool shaft 26 has been removed from the lower body 24. This may be accomplished by moving the ring 46 toward the handle 14, as illustrated by the first arrow 56. This may compress the lower body spring 44. A retraction groove 58 may be located in a lower portion of the ring 46, whereby the locking ball 54 may retract away from the tool shaft 26, as illustrated by the second arrow 60. This may release the locking ball 54 from the ball groove 52 in the attachment end 40 of the tool shaft 26, allowing the tool shaft 26 to be removed from the lower body 24 as indicated by the third arrow 62. At this point, if desired, the tool shaft 26 may be rotated so as to position the tool tip 28 in a different position relative to the lower body 24 and reinserted into the lower body 24 so that a flat surface 50 of the attachment end 40 of the tool shaft 26 is aligned with a flat surface 50 of the lower body 24. The ring 46 may then be released and the lower body spring 44 may position the ring 46 in its lower position, as previously shown. The movement of the ring 46 may cause the locking ball out of the retraction groove 58 and move inward toward the ball groove 52, as previously shown. This process may allow for the tool tip 28 of the tool shaft 26 to be moved to a different position relative to the lower body 24 as illustrated by the rotation arrow 64.

Figure 10:
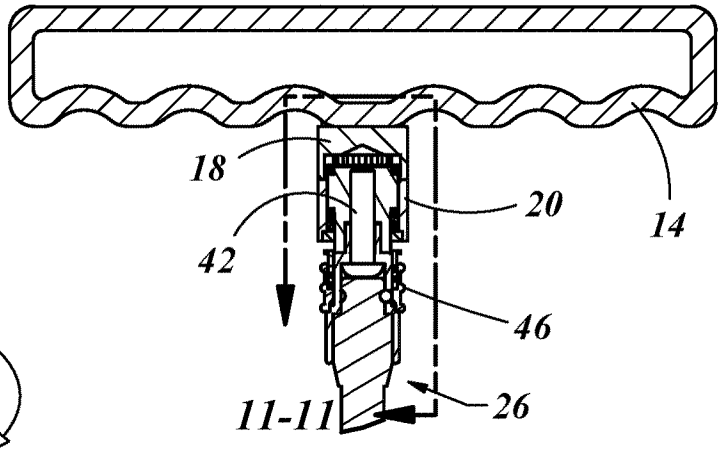
FIG. 10 is a sectioned view of the adjustable dent removal tool as presented in FIG. 9 and cut along line 10-10.
Figure 11:
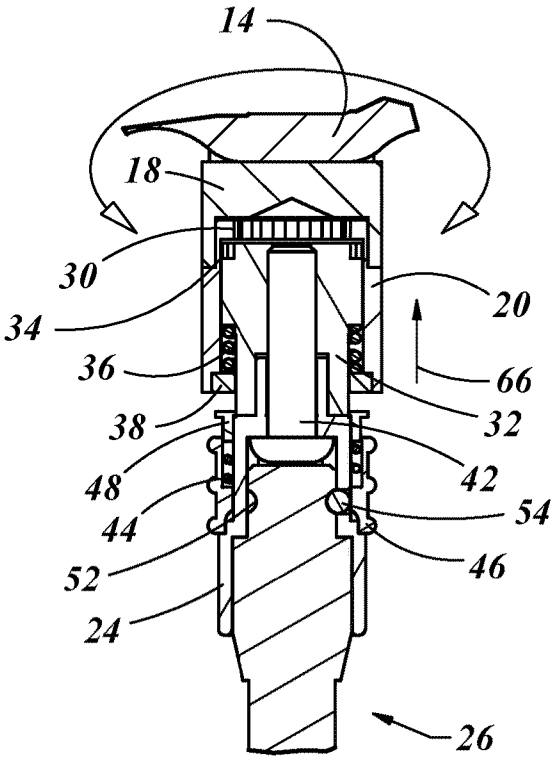
FIG. 11 is a detail view of the adjustable dent removal tool as presented in FIG. 10, cut along line 11-11.
Figure 9:
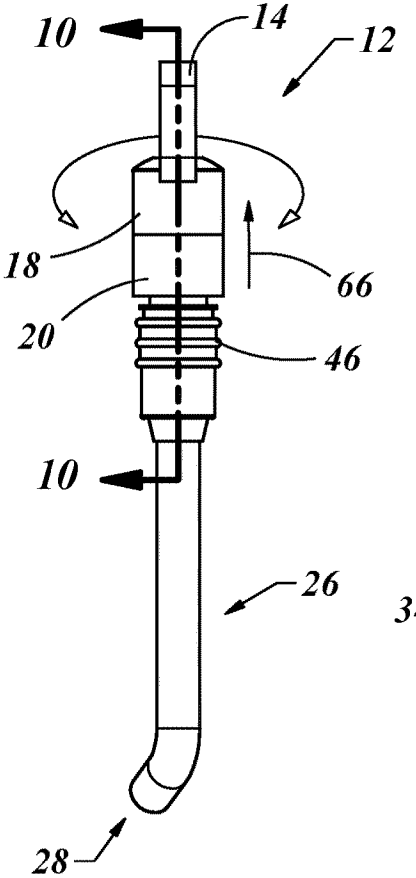
FIG. 9 is an adjustable dent removal tool as presented in FIG. 1, with the body displaced from the piston so as to allow positional adjustment of the handle relative to the lower body.

To move the tool tip 28 of the tool shaft 26 relative to the lower body 24, as previously described, may require the tool shaft 26 to be removed from the work area, meaning the entire adjustable dent removal tool 12 may be needed to be removed from the area of the vehicle or other device that is being worked on. This may take more time than desired by the worker if only a small adjustment in positioning of the tool tip 28 is what is needed. To solve that problem, the present invention may include an adjustment that may be provided by the first assembly of the duel adjustment system. This is further illustrated in FIGS. 9-11.

These figures show how the adjustable dent removal tool 12 may have the tool shaft 26 remain stationary with respect to the workpiece and the handle 14 may be rotated with respect to the tool tip 28. In this embodiment the handle 14 may be pulled away from the tool shaft 26, as illustrated by the fourth arrow 66. The movement of the handle 14, which will include the cap 18 and the body 20 due to the attachment to the handle as previously disclosed, may cause a compression of the piston spring 36 as the handle 14 is moved away from the piston 32. This may disengage the first engagement teeth 30 of the body 20 from the second engagement teeth 34 of the piston 32. This may allow the body 20 (and therefore the handle 12) to rotate about the piston 32. The user many then release tension on the handle 14, allowing the piston spring 36 to relax and push the second engagement teeth 34 of the piston 32 back into the first engagement teeth 30 of the body 20, thereby locking the body 20 (and therefore the handle 14) to the piston 32, as it applies to rotary movement of the piston 32 relative to the body 20. The result may be an angular adjustment of the handle 14 relative to the tool tip 28 without the need to remove the adjustable dent removal tool 12 from the workpiece.

This process saves time in that fewer steps are needed to make the adjustment using this, the first assembly of the duel adjustment system, as opposed to the second assembly of the duel adjustment system, as previously shown and described, where the tool shaft 26 is removed from the lower body 24. In addition, with this "handle only" adjustment, the tool tip 28 does not need to be relocated to the workpiece to find the dent in the workpiece, as it may if the entire tool shaft 26 were removed from the workpiece. As previously noted, in many cases the convex portion of the dent, where the force needs to be applied, is not visible from the worker's perspective. This may be a process that requires the worker to move and feel the adjustable dent removal tool 12 to locate it in the correct position that may not be necessary to move when only adjusting the position of the handle 14. The result of the combination of the adjustments, as presented herein, is increased functionality and adjustability with two adjustment capabilities that may be used by the worker at that time.

Figure 12B:
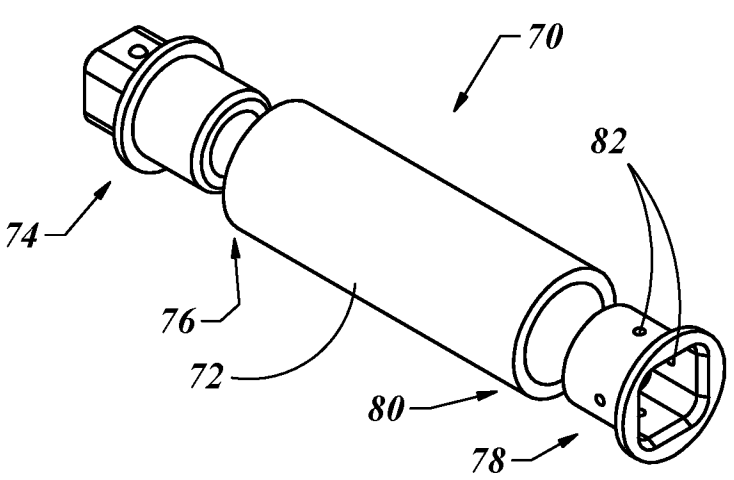
FIG. 12*b* is an isometric view of the handle segment of FIG. 12*a*, shown from the side nearest the female coupling.
Figure 12D:
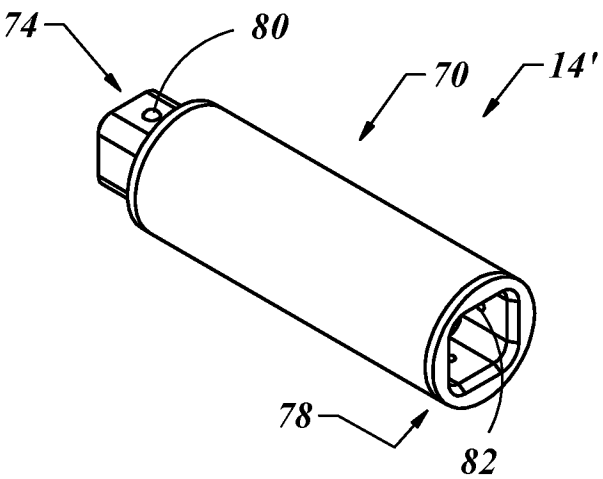
FIG. 12*d* is an isometric view of the assembled handle segment of FIG. 12*b*.
Figure 12A:
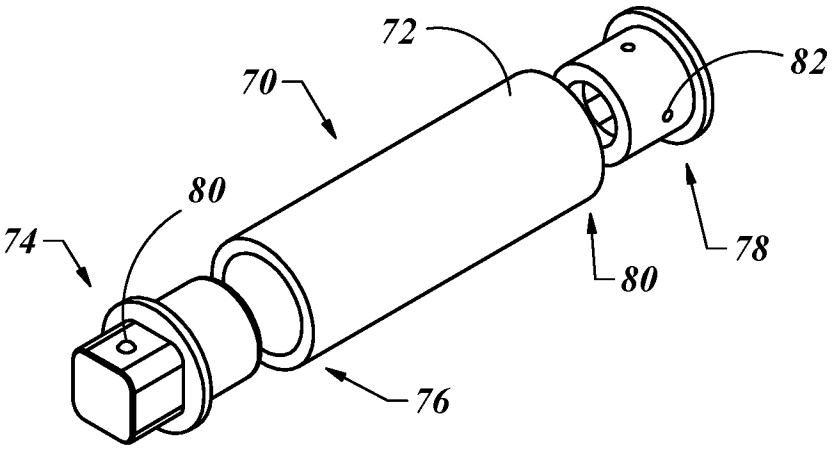
FIG. 12*a* is an isometric exploded view of a handle segment shown from a side nearest the male coupling.
Figure 12C:
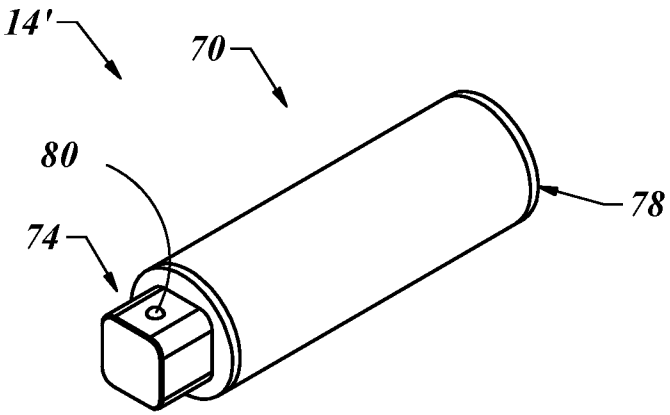
FIG. 12*c* is an isometric view of the assembled handle segment of FIG. 12*a*.

Another embodiment of the handle 14 may be found in FIGS. 12*a*-12*d*. Here the handle 14' may be comprised of one or more handle segments 70. These handle segments 70 may be made up of a longitudinal tube 72 with a male coupling 74 on a first end 76 of the tube 72 and a female coupling 78 on a second end 80 of the tube 72. FIGS. 12*a* and 12*b* show these parts prior to final assembly. The fully assembled handle segment 70 is shown in FIGS. 12*c* and 12*d*. The length of the tube 72 may be varied to make shorter or longer handle segments 70.

It will become more apparent in the detail below that it may be desirable to provide multiple handle segments 70 of varying lengths. In doing so the male coupling 74 may be inserted into the female coupling 78 to make a longer handle 14'. To assist in allowing more than one handle segment 70 to be releasably joined together, a detent ball 80 may be received by a portion of the male coupling 74. The detent ball 80 may be biased by way of a spring (not shown) outward away from the surface of the male coupling 74. When the male coupling 74 is inserted into the female coupling 78, the detent ball 80 may be received by a detent ball receiver 82. The spring force provided on the detent ball 80 into the detent ball receiver 82 may provide a secure positioning of one handle segment 70 to any adjacent handle segment 70. The spring biased detent ball 80 may be retracted further into the body of the male coupling 74 when sufficient force is applied to remove the male coupling 74 side of the handle segment 70 from a female coupling 78 side of a handle segment 70. This may allow the handle segments 70 to be releasably secured to one another while providing a secure coupling of the adjacent handle segments 70 to one another while in use as a handle 14'.

Figure 13A:
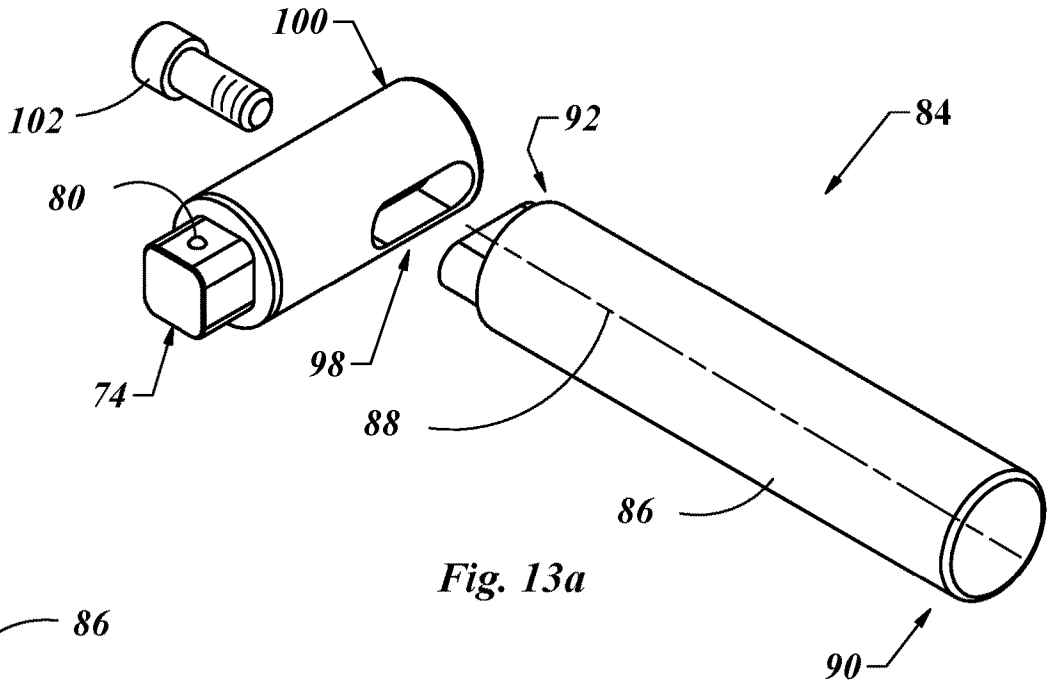
FIG. 13*a* is an isometric exploded view of a handle grip shown from a side nearest a distal end of the handle bar.
Figure 13B:
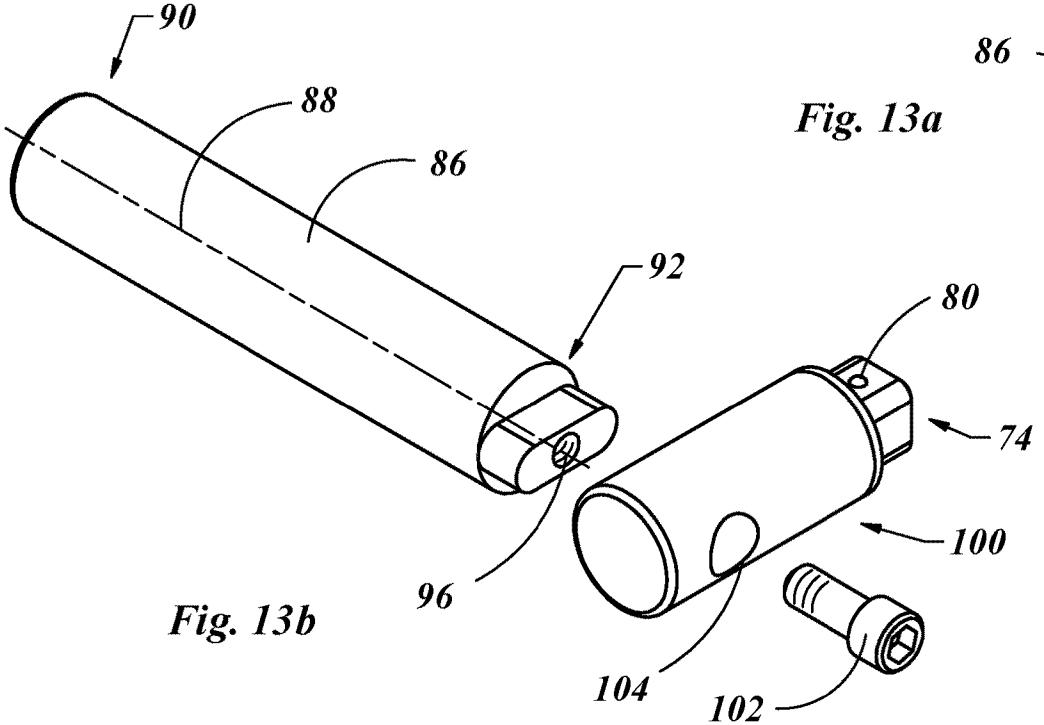
FIG. 13*b* is an isometric exploded view of the handle grip of FIG. 13*a*, shown from a side away from the distal end of the handle bar.

Another type of handle attachment is presented in FIGS. 13*a* and 13*b*. Here a handle grip 84 is provided which may include an elongated handle bar 86. The handle bar 86 may include a bar long axis 88. A distal end 90 of the handle bar 86 may be provided opposite to a receiver end 92. The receiver end 92 may include an elongate tab 94 with a threaded cavity 96. This elongate tab 94 may be received by a slot 98 in a handle grip connector 100. The elongated geometry of the elongate tab 94 and the slot 98 may provide for stability against rotation of the handle bar 86 after it is connected to the handle grip connector 100. A screw 102 may be positioned in a hole 104 in the handle grip connector 100 and the threads of the screw 102 may engage with the threaded cavity 96 of the handle bar 86. This is by no means the only form of connected for the handle grip connector 100 to the handle bar 86, but the simplicity and durability of the connection is worth noting. The handle grip connector 100 may include a male coupling 74 with a detent ball 80 as previously noted.

Figure 14A:
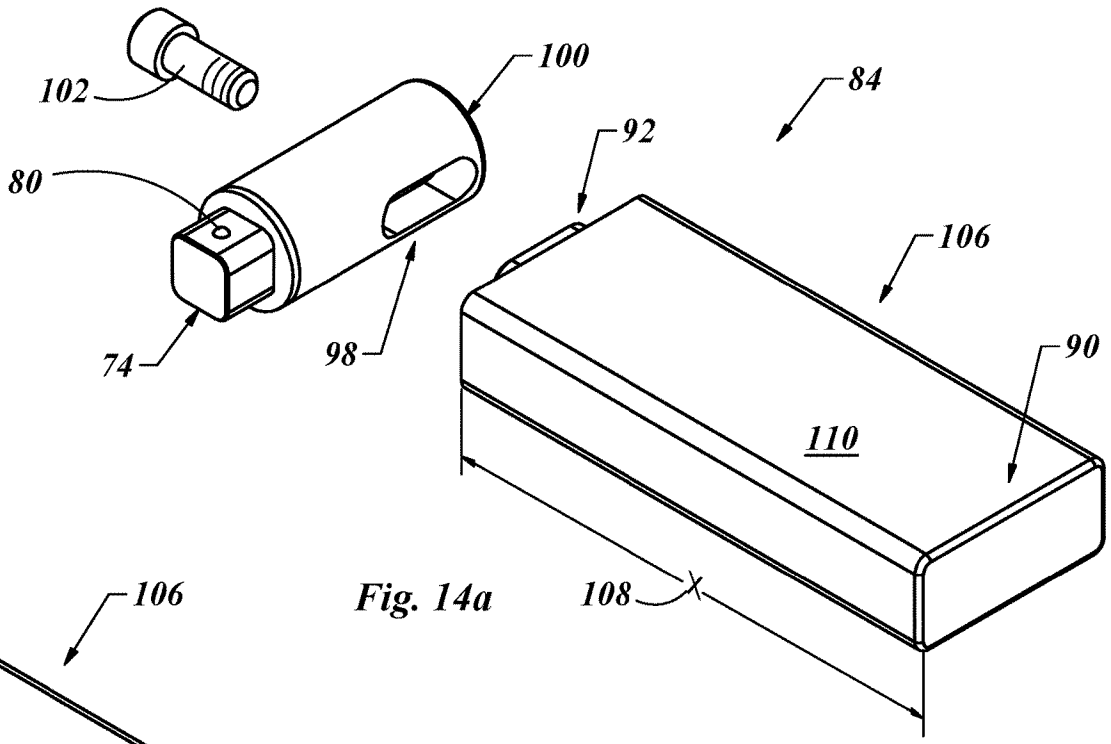
FIG. 14*a* is an isometric exploded view of a handle grip with a flat support bar, shown from a side nearest a distal end of the flat support bar.
Figure 14B:
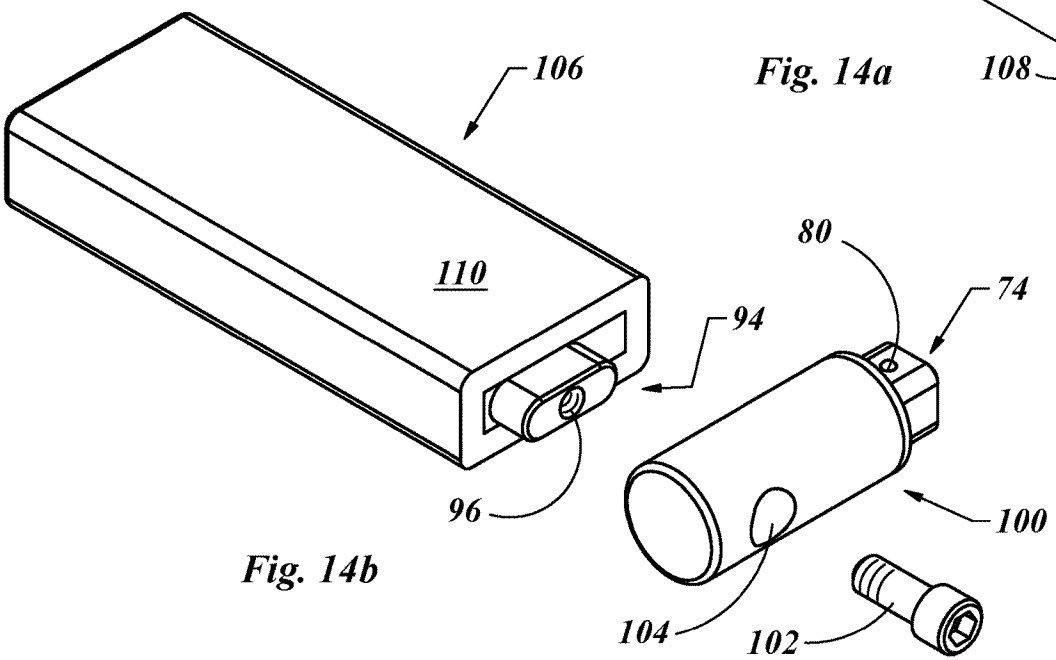
FIG. 14*b* is an isometric exploded view of the handle grip of FIG. 14*a*, shown from a side away from the distal end of the flat support bar.

Another embodiment of the handle grip 84 is shown in FIGS. 14*a* and 14*b*. In this embodiment the handle grip connector 100 with a male coupling 74 and the screw 102 may be similar to that as already presented. The difference is the handle bar 90 has been replaced with a flat support bar 106. The flat support bar 106 may also include a distal end 90 and a long dimension 108. The primary difference between the flat support bar 106 and the handle bar 86 is the substantially flat surface 110 on the flat support bar 106. As will be shown in more detail below, a tool handle is only useful if it is adapted to transmit force from a user to a work piece. In some cases, a flat surface is preferable to apply a significant amount of force to in that there may be a greater contact area between the user and the handle grip 84 with a flat surface. For any given force applied to the handle grip 84 where the area of contact between the user and the handle grip 84 is increased, the pressure is decreased. This may make the handle grip 84 more comfortable to use or allow the user to apply more force, thereby increasing the utility of the tool as a whole.

Figure 15:
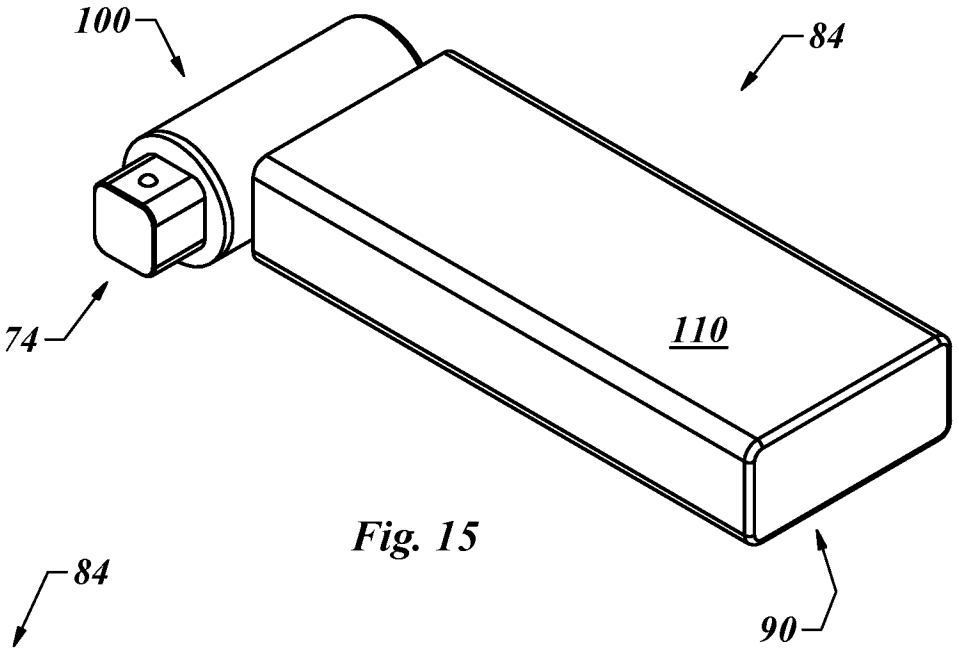
FIG. 15 is an isometric view of the handle grip of FIGS. 14*a* and 14*b*, shown as assembled.
Figure 16:
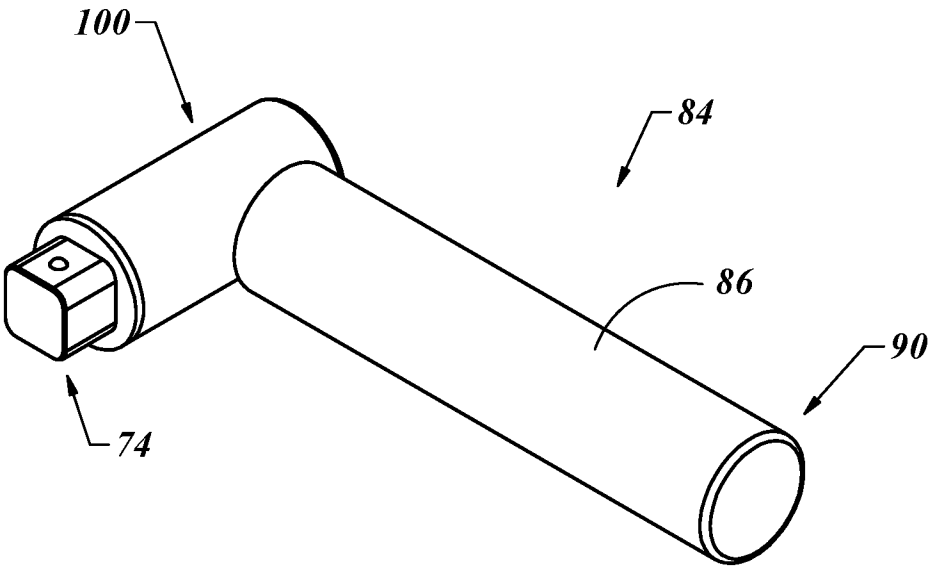
FIG. 16 is an isometric view of the handle grip of FIGS. 13*a* and 13*b*, shown as assembled.

The exploded handle grip 84 assemblies of FIGS. 14*a* and 14*b* are shown in an assembled state in FIG. 15. Likewise, the exploded handle grip 84 assemblies of FIGS. 13*a* and 13*b* are shown in an assembled state in FIG. 16. In both embodiments, the flat support bar 106 and the handle bar 86 are securely connected to their respective handle grip connectors 100.

Figure 17:
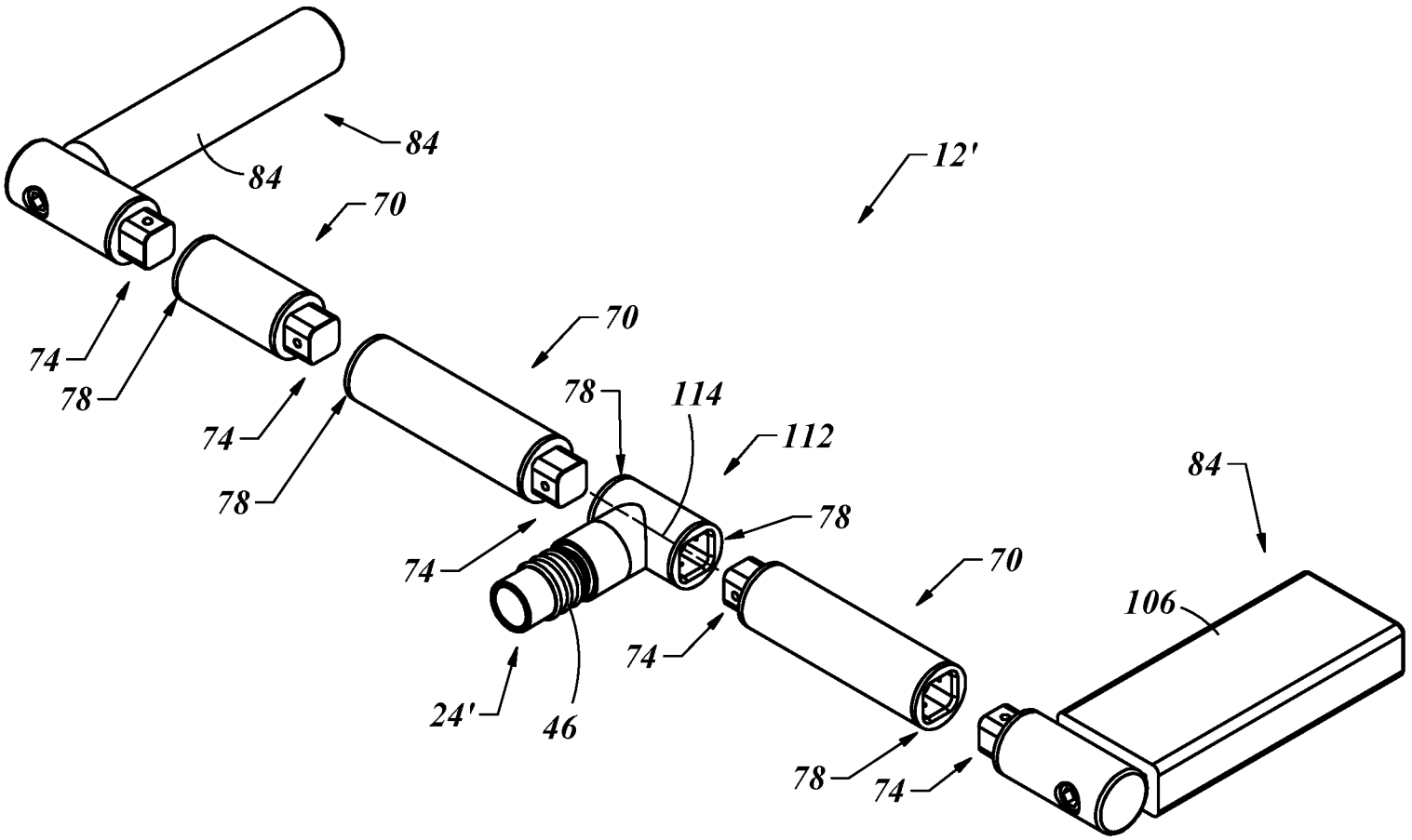
FIG. 17 is an isometric exploded view of one embodiment of an adjustable dent removal tool assembly.

In FIG. 17, an exploded view of an adjustable dent removal tool 12' is shown. Here some longer handle segments 70 are mixed in with shorter handle segments 70. In addition, a handle grip 84 with a handle bar 86 is located on one end and a handle grip 84 with a flat support bar 106 is positioned on the other end of the assembly 12'. Near the center is a receiver body 112 with two female couplings 78 positioned along a common axis 114. The receiver body 112 may also include a lower body 24' and a ring 46 as previously shown and described. The functional aspects of the receiver body 112 may be consistent with the elements and workings as shown in FIG. 2, including the use of a tool shaft 26 with a tool tip 28, though not shown here, but this tool may be used in this embodiment in a similar manner.

Figure 18:
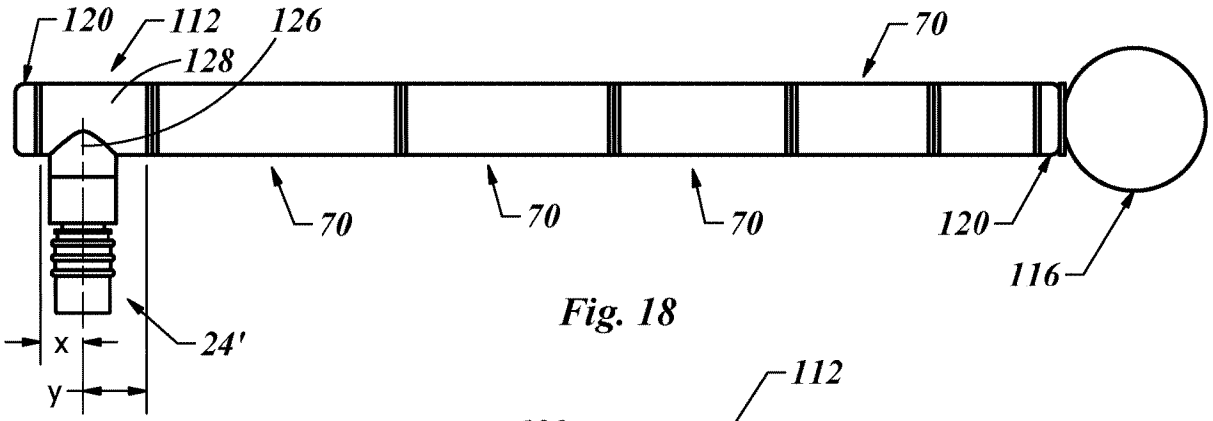
FIG. 18 is a side view of an embodiment of an adjustable dent removal tool assembly with a receiver body on one end of the assembly and a ball handle on the other end.
Figure 19:
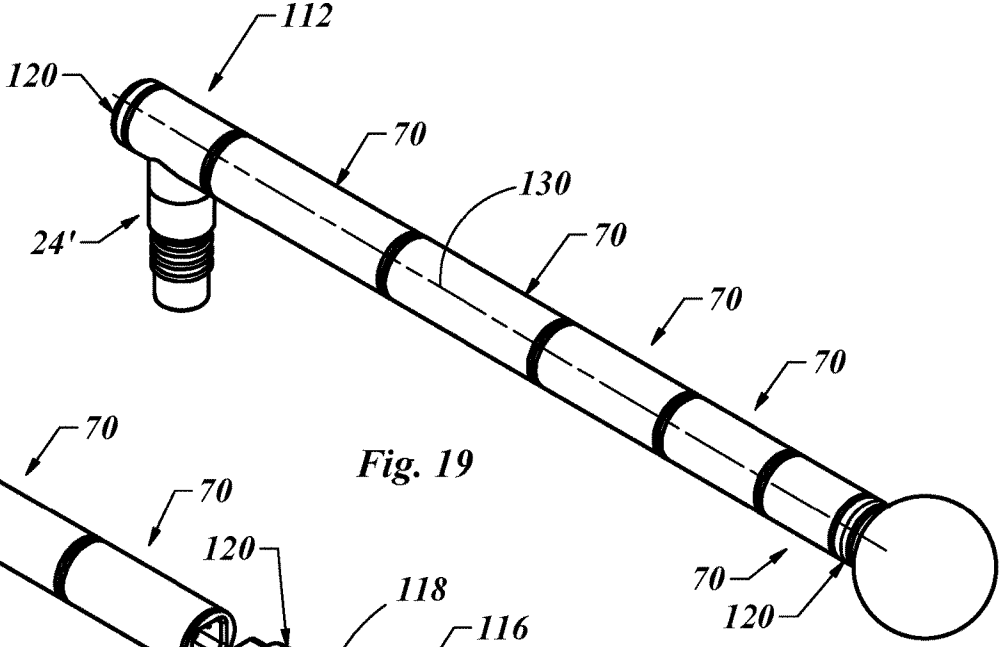
FIG. 19 is an isometric view of the adjustable dent removal tool of FIG. 18.
Figure 20:
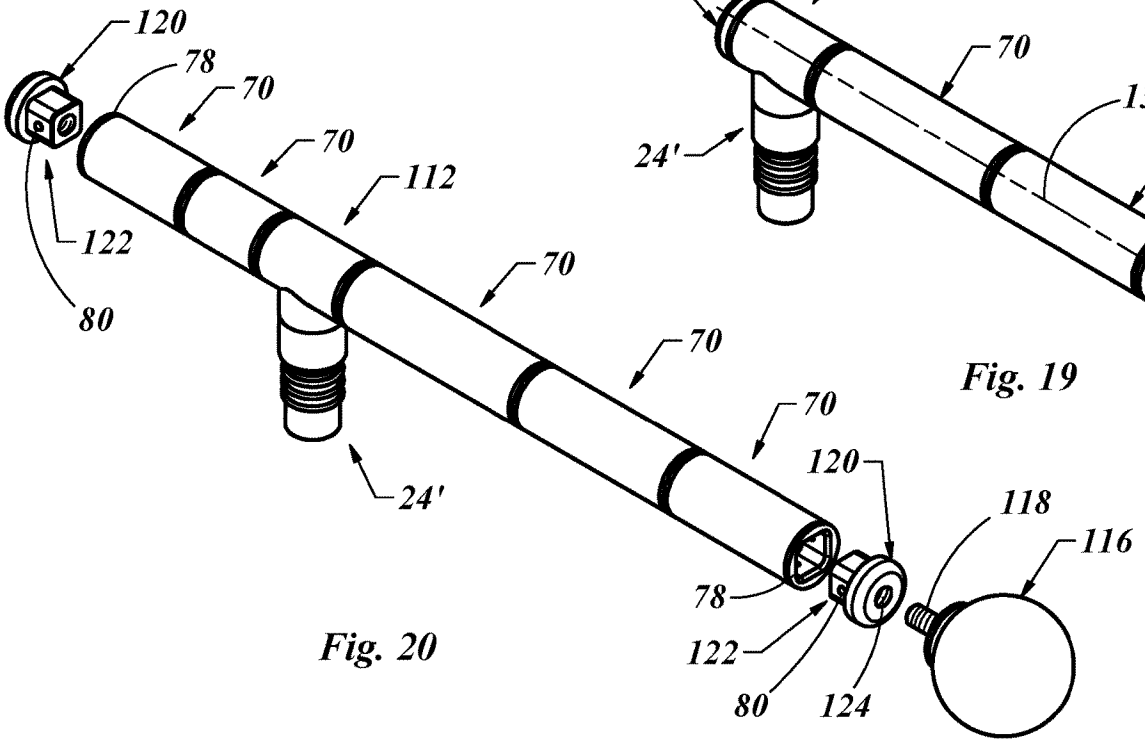
FIG. 20 is an isometric partially exploded view of a different combination of the adjustable dent removal tool of FIG. 18, shown with a threaded end cap on each end of the handle segments assembly and the ball handle adjacent to the threaded end cap.

Another assembled embodiment of the adjustable dent removal tool 12" is shown in FIGS. 18-20. Here the handle segments 70 are connected into a long chain which may have a common handle long axis 130 to make one solid handle 14' of the adjustable dent removal tool 12". The number and combination of handle segments 70 is up the needs of the user. The receiver body 112 may be positioned near one end of the solid handle 14' as shown in FIGS. 18-19, or positioned between the two ends, as shown in FIG. 20. As noted above, the adjustable dent removal tool 12" may include a tool shaft 26 with a tool tip 28 (not shown in these views) to be used to manipulate dents out of automobile bodies. Any system where more force can be generated by the user to be applied to the dent is beneficial in accomplishing the task of dent removal. In some cases, a longer handle is better as it allows for more torque to be applied. In other environments the space allowed to insert the tool 12" is limited, so a shorter handle 14' may be needed. By placing the receiver body 112 in between the two ends of the handle 14', as is shown in FIG. 20, the user may push on one end and pull on the other end of the handle 14'. With only five handle segments 70 of different lengths and the one receiver body 112, there are twenty-three different possible combinations of the adjustable dent removal tool 12".

Another variation to the adjustable dent removal tool 12" is the addition of a ball handle 116. The ball handle 116 may be positioned on one or both ends of the handle 14'. The ball handle 116 may include a threaded portion 118 that may be threaded into a threaded end cap 120. The threaded end cap 120 may include a male portion 122 of a male coupling 74, including a detent ball 80. The threaded end cap 120 may be releasably received by the female coupling 78 of any handle segment 70. The ball handle 116 may then be screwed into the receiving threads 124 of the threaded end cap 120, thereby securing the ball handle 116 to the handle 14'.

In some embodiments, the threaded end cap 120 may be manufactured of a durable material such as a plastic. As such, the threaded end cap 120 may be used as a "bumper" placed on the end of the handle 14' (as in FIGS. 18-19) as a barrier between the end of the handle segment 70 or receiver body 112, both of which are likely made of high strength steel, and the painted body of the vehicle under repair. This "bumper" may prevent unintentional damage from the use of adjustable dent removal tool 12" to the automobile.

An additional feature of the receiver body 112 is best shown in FIG. 18. A long receiver axis 126 is provided which is about the center of the lower body 24' of the receiver body 112. The handle body 128 of the receiver body 112 may be positioned off centered relative to the long receiver axis 126, as noted by the dimensions "x" and "y". This may be intentional in that the receiver body 112 may be provided in this position as shown, or reversed with the "y" dimension nearer the threaded end cap 120. As noted previously, the adjustable dent removal tool 12" may be placed in locations with little or no extra room. Even this seemingly small ability to manipulate the tool tip 28 (not shown here) in the receiver body 112 relative to the handle 14' may make a difference in the completing the task of removing a dent.

The foregoing detailed description of the present invention is provided for purpose of illustration, and it is not intended to be exhaustive or to limit the invention to the particular embodiment shown. The embodiments may provide different capabilities and benefits, depending on the configuration used to implement key features of the invention.

What is claimed is:

1. An adjustable dent removal tool, comprising:

an elongated handle comprising two or more handle segments each with a male coupling and a female coupling, the elongated handle coupled to a receiver body which includes a duel adjustment system, the duel adjustment system including:

the receiver body including a plurality of first engagement teeth;

a piston movably coupled to the receiver body, the piston including a plurality of second engagement teeth;

a piston spring providing a bias of the piston on the receiver body such that the second engagement teeth of the piston interlock with the first engagement teeth of the receiver body;

a lower body, with a first axis, secured to the receiver body, with a second axis, the first axis of the lower body being perpendicular to the second axis of the receiver body, the lower body including a locking ball which articulates with a ring such that the ring holds the ball in a recessed position when the ring is in a first position and allows the ball to move to a retracted position when the ring is in a second position, the lower body also including a tool receiver; and a lower body spring supported by the lower body and providing a bias of the ring toward the first position.

2. The adjustable dent removal tool according to claim 1, wherein the two or more handle segments is further comprised of a plurality of handle segments of varying lengths.

3. The adjustable dent removal tool according to claim 2, wherein each of the plurality of handle segments has a male coupling on a first end and a female coupling on a second end.

4. The adjustable dent removal tool according to claim 1, wherein the receiver body includes two female couplings positioned along the second axis.

5. The adjustable dent removal tool according to claim 1, further comprising a handle grip releasably secured to the elongated handle.

6. The adjustable dent removal tool according to claim 5, wherein the handle grip includes a handle bar with a long axis positioned perpendicular to a long axis of the elongated handle.

7. The adjustable dent removal tool according to claim 6, further comprising a handle grip connector with a male coupling on one end, the handle bar secured to the handle grip.

8. The adjustable dent removal tool according to claim 5, wherein the handle grip includes a flat support bar with a long dimension positioned perpendicular to a long axis of the elongated handle.

9. The adjustable dent removal tool according to claim 1, further comprising a ball handle with a threaded portion received by an end cap, the end cap including a male coupling which is received by a handle segment.

10. An adjustable dent removal tool of the type including an elongated handle comprising at least two handle segments each with a male coupling and a female coupling and a removable tool shaft, the adjustable dent removable tool comprising:

a receiver body releasably secured to the elongated handle, the receiver body including a plurality of first engagement teeth;

a piston movably coupled to the receiver body, the piston including a plurality of second engagement teeth;

a piston spring providing a bias of the piston toward the receiver body such that the second engagement teeth of the piston interlock with the first engagement teeth of the body;

a lower body secured to the receiver body, the lower body including a locking ball which articulates with a ring such that the ring holds the ball in a recessed position when the ring is in a first position and allows the ball to move to a retracted position when the ring is in a second position, the lower body also including a tool receiver;

a lower body spring supported by the lower body and providing a bias of the ring toward the first position; and a handle grip with a handle bar including a long axis positioned perpendicular to a long axis of the elongated handle.

11. The adjustable dent removal tool according to claim 10, wherein the at least two handle segments is further comprised of a plurality of handle segments of varying lengths.

12. The adjustable dent removal tool according to claim 11, wherein each of the plurality of handle segments has a male coupling on a first end and a female coupling on a second end.

13. The adjustable dent removal tool according to claim 10, wherein the receiver body includes two female couplings positioned along a common axis.

14. The adjustable dent removal tool according to claim 13, wherein the lower body is positioned perpendicular to the common axis of the receiver body.

15. The adjustable dent removal tool according to claim 10, wherein the handle grip is releasably secured to the elongated handle.

16. The adjustable dent removal tool according to claim 10, further comprising a handle grip connector with a male coupling on one end, the handle bar secured to the handle grip.

17. The adjustable dent removal tool according to, claim 10 wherein the handle grip includes a flat support bar with a long dimension positioned perpendicular to a long axis of the elongated handle.

18. The adjustable dent removal tool according to claim 10, further comprising a ball handle with a threaded portion received by an end cap, the end cap including a male coupling which is received by a handle segment.

* * * * *